US010952914B1

(12) United States Patent
Miller et al.

(10) Patent No.: US 10,952,914 B1
(45) Date of Patent: Mar. 23, 2021

(54) CLAMP APPARATUS FOR ATTACHING A SURGICAL ACCESSORY TO A MOUNTING RAIL

(71) Applicants: Howard P. Miller, Concord, MD (US); Thomas K. Skripps, Acton, MD (US)

(72) Inventors: Howard P. Miller, Concord, MD (US); Thomas K. Skripps, Acton, MD (US)

(73) Assignee: Kyra Medical, Inc, Northborough, MA (US)

( * ) Notice: Subject to any disclaimer, the term of this patent is extended or adjusted under 35 U.S.C. 154(b) by 392 days.

(21) Appl. No.: 15/887,260

(22) Filed: Feb. 2, 2018

Related U.S. Application Data

(63) Continuation-in-part of application No. 15/706,231, filed on Sep. 15, 2017.

(60) Provisional application No. 62/601,545, filed on Mar. 27, 2017, provisional application No. 62/600,277, filed on Feb. 17, 2017, provisional application No. 62/600,260, filed on Feb. 17, 2017.

(51) Int. Cl.
*A61G 13/10* (2006.01)
*A61G 13/12* (2006.01)

(52) U.S. Cl.
CPC ..... *A61G 13/101* (2013.01); *A61G 13/1245* (2013.01); *A61G 2200/327* (2013.01)

(58) Field of Classification Search
CPC ..... A61G 13/101; A61G 13/1245; A61G 2203/78
See application file for complete search history.

(56) References Cited

U.S. PATENT DOCUMENTS 4,018,412 A * 4/1977 Kees, Jr. ..... A61G 13/101 248/214
4,796,846 A * 1/1989 Meier ..... A61B 17/02 248/286.1
4,886,258 A * 12/1989 Scott ..... A61G 13/12 5/624
6,564,406 B2 * 5/2003 VanSteenburg ..... A61G 13/12 5/621
6,704,959 B2 * 3/2004 Schuerch ..... A61G 13/12 5/623
7,520,007 B2 * 4/2009 Skripps ..... A61G 13/04 24/459
RE41,412 E * 7/2010 Van Steenburg .. A61G 13/0009 5/602
8,322,342 B2 * 12/2012 Soto ..... A61G 13/12 128/845

(Continued)

*Primary Examiner* — Bradley Duckworth
(74) *Attorney, Agent, or Firm* — Nelson Mullins Riley & Scarborough LLP; Thomas J. Engellenner; Reza Mollaaghababa

(57) ABSTRACT

An apparatus for attaching a surgical accessory to a mounting rail comprises a clamp body, a locking plate component, and a clamp release mechanism. The clamp body includes at least one clamp jaw component and one or more mounting mechanisms for attaching a mount blade of a surgical accessory to the clamp body. The locking plate component is coupled to the clamp body in a manner that a rail channel is formed between the clamp jaw component and the locking plate component. The clamp release mechanism includes an actuator. The clamp release mechanism moves to allow a mounting rail to enter or exit the rail channel in response to (a) a force applied to the locking plate component or (b) activation of the actuator.

22 Claims, 8 Drawing Sheets

(56) References Cited

U.S. PATENT DOCUMENTS

| | | | | |
|---|---|---|---|---|
| 8,448,274 | B2 * | 5/2013 | Broens | A61G 13/12 5/624 |
| 8,833,707 | B2 * | 9/2014 | Steinberg | A61G 13/102 128/849 |
| 9,022,334 | B1 * | 5/2015 | DeMayo | F16M 13/022 248/229.22 |
| 9,107,784 | B2 * | 8/2015 | Doyle | A61G 7/05 |
| 9,469,438 | B2 * | 10/2016 | Nool | B65D 25/22 |
| 9,554,959 | B2 * | 1/2017 | Carn | A61G 13/123 |
| 9,615,987 | B2 * | 4/2017 | Worm | A61G 13/101 |
| 9,951,904 | B2 * | 4/2018 | Perez | F16M 13/022 |
| 9,993,381 | B2 * | 6/2018 | Blackwell | A61G 13/101 |
| 10,292,883 | B2 * | 5/2019 | Jepsen | F16M 11/08 |
| 10,357,416 | B2 * | 7/2019 | Cole | A61G 13/1255 |
| 10,478,363 | B2 * | 11/2019 | Koch | F16M 13/022 |
| 10,478,364 | B2 * | 11/2019 | Fossez | A61G 13/1245 |
| 10,531,974 | B2 * | 1/2020 | Hunter, Jr. | A61F 5/042 |
| 10,617,586 | B2 * | 4/2020 | Katzenstein | A61G 13/101 |
| 2016/0296401 | A1 * | 10/2016 | Cole | A61G 13/101 |
| 2016/0324701 | A1 * | 11/2016 | Cambridge | F16B 2/185 |
| 2017/0143572 | A1 * | 5/2017 | Bergman | A61G 13/101 |
| 2017/0224569 | A1 * | 8/2017 | Pfeuffer | B25B 5/08 |
| 2017/0326015 | A1 * | 11/2017 | Katzenstein | F16B 2/185 |
| 2018/0028387 | A1 * | 2/2018 | Yellin | A61B 90/50 |
| 2018/0073528 | A1 * | 3/2018 | Pryor | B25B 5/06 |

* cited by examiner

CLAMP APPARATUS FOR ATTACHING A SURGICAL ACCESSORY TO A MOUNTING RAIL

CROSS-REFERENCE TO RELATED APPLICATIONS

This application is a continuation-in-part of application Ser. No. 15/706,231 filed Sep. 15, 2017, which claims the benefit of U.S. Provisional Application Ser. Nos. 62/601,545 filed Mar. 27, 2017, 62/600,260 filed Feb. 17, 2017, and 62/600,277 filed Feb. 17, 2017, each of which is incorporated herein by reference in their entirety.

TECHNICAL FIELD

The present disclosure relates generally to a clamp apparatus for attaching a surgical accessory to a surgical mounting rail at any point along the rail. The clamp apparatus described herein may be used in combination with various surgical accessories and in various surgical scenarios.

BACKGROUND

Mounting rails (or simply "rails") such as those found on surgical tables or medical beds are a common, and convenient, method for mounting a surgical accessory. The term "surgical accessory," as used herein, refers generally to any device or instrument used in conjunction with a mounting rail during surgical and other medical procedures. Examples of surgical accessories include lithotomy stirrups and retractors. There are many clamping devices that have been designed for such use on these rails for securing surgical accessories to surgical table rails. Rail clamping devices can be as simple as a C-shaped clamp with clamp jaw components that slide over the rail and mate with its cross-sectional geometry or more complex rail clamps that include spring-loaded clamp jaw components that move about the rail for more precise placement and positioning. All such rail clamps contain a channel, typically rectilinear, that allows the clamp to accept and sufficiently confine the rail to resist inadvertent dismounting of the rail clamp. Once this rail clamp is in place on the rail, an accessory can be added and secured in place. Due to the mating geometry between the inside surfaces of the rail clamp and the outside surfaces of the rail, the rail clamp can be moved to the desired position along the length of the rail. Surgical accessories or instruments, such as lithotomy stirrups or retractors, have round posts or rectilinear "blades" which, in the current art, are inserted into apertures, typically holes or slots, in the rail clamp after the rail clamp is mounted to the surgical rail. After the accessory is inserted into the rail clamp, a threaded stud, cam or other mechanical means are used to lock the accessory and rail clamp in place.

Many conventional rail clamps are difficult to employ quickly for various reasons. Some designs include a solid, C-shaped body that restricts mounting "mid-rail" and therefore must be slipped over the end of and parallel to the rail. Others may require multiple adjustments before the rail clamp can be secured or require awkward hand movements to release the clamp from the rail. If any current clamp designs were made integral to the surgical accessories, rather than as a separate device, any of the issues mentioned above may prevent the accessory/clamp combination device from being easily and safely mounted to or removed from the rail. As stated above, conventional clamps must first be mounted onto the surgical rail, and then the blade or post of the accessory can be inserted into the mating aperture. Only after these two steps can the coupled pair be fixed in place on the rail through the means employed by the clamp design.

Operating room suites and medical wards typically have numerous rooms, surgical tables and/or beds. Each of these rooms should have adequate rail clamps available to mount the appropriate surgical accessories to the table that are required for the procedure. However, in reality, these clamps can be lost, misplaced or moved to other rooms, reducing the number of clamps available to the clinical team when needed. When clamps are not readily available, procedures may be delayed while the staff searches the ward for replacements.

A combination surgical accessory/rail clamp device is a possible remedy to the lost clamp problem, but the current art has shortcomings that prevent a realistic solution. With the current art, a clamp cannot be attached to a surgical accessory and then mounted to the rail since the presence of the surgical accessory blade impedes the rail channel during mounting. One solution to this problem, using the current art, could be to weld or otherwise permanently attach the post or blade of the accessory to the body of the rail clamp since this would eliminate the issue with impeding the rail channel. However, with this solution, if the clamp portion of this new combination becomes damaged, the entire accessory becomes unusable. Removing the clamp would be very difficult and, if it could be removed, the remaining portion of the accessory could not be otherwise attached to the rail using a blade or post.

SUMMARY

Embodiments of the present invention address and overcome one or more of the above shortcomings and drawbacks, by providing methods, systems and the apparatus for a rail clamp that attaches surgical accessories to the mounting rails of surgical tables or medical beds. The rail clamp described herein can be mounted anywhere along the length of the mounting rail. The clamp may be coupled with a mount blade of a surgical accessory, thereby allowing the surgical accessory to be placed at any position along the rail. Furthermore, the clamp may be readily detached from the mount blade to allow repair or replacement of the clamp without replacement of the surgical accessory.

According to some embodiments, an apparatus for attaching a surgical accessory to a mounting rail comprises a clamp body, a locking plate component, and a clamp release mechanism. The clamp body includes at least one clamp jaw component and one or more mounting mechanisms for attaching a mount blade of a surgical accessory to the clamp body. The locking plate component is coupled to the clamp body in a manner that a rail channel is formed between the clamp jaw component and the locking plate component. The clamp release mechanism includes an actuator. The clamp release mechanism moves to allow a mounting rail to enter or exit the rail channel in response to (a) a force applied to the locking plate component or (b) activation of the actuator.

According to another aspect of the present invention, a surgical apparatus includes a surgical accessory comprising a mount blade, a clamp, and a mounting mechanism that couples the mount blade to the clamp. The clamp comprises a clamp body; a locking plate component; and a clamp release mechanism. The clamp release mechanism allows movement of the locking plate component relative to the clamp body, thereby allowing the clamp to be (a) securely attached to the mounting rail or (b) removed from the mounting rail at any point along the length of the mounting rail.

According to other embodiments of the present invention, a surgical apparatus includes a surgical accessory, a clamp, and one or more mounting mechanisms. The surgical accessory comprises a support structure and a mount blade. The clamp includes an actuation mechanism that allows selective attachment and release of the clamp from a mounting rail. The mounting mechanisms couple the mount blade to the clamp and allow forces exerted on the mount blade by the support structure to be transferred to the clamp body.

Additional features and advantages of the invention will be made apparent from the following detailed description of illustrative embodiments that proceeds with reference to the accompanying drawings.

BRIEF DESCRIPTION OF THE DRAWINGS

The foregoing and other aspects of the present invention are best understood from the following detailed description when read in connection with the accompanying drawings. For the purpose of illustrating the invention, there are shown in the drawings embodiments that are presently preferred, it being understood, however, that the invention is not limited to the specific instrumentalities disclosed. Included in the drawings are the following Figures.

DETAILED DESCRIPTION

Systems, methods and apparatuses are described herein which relate generally to a rail clamp that can be configured to attach to a mounting rail that is typically available on surgical tables or medical beds. This clamp apparatus, referred to herein as a "Secure Release Clamp" is designed to attach to a mount blade of the surgical accessory in a manner that allows the surgical accessory to be safely attached to and removed from any position along the mounting rail of the surgical table. Additionally, the Secure Release Clamp described herein can be readily removed from the mount blade of the surgical accessory, thus allowing the clamp to be repaired or replaced without requiring replacement of the surgical accessory.

Figure 1A:
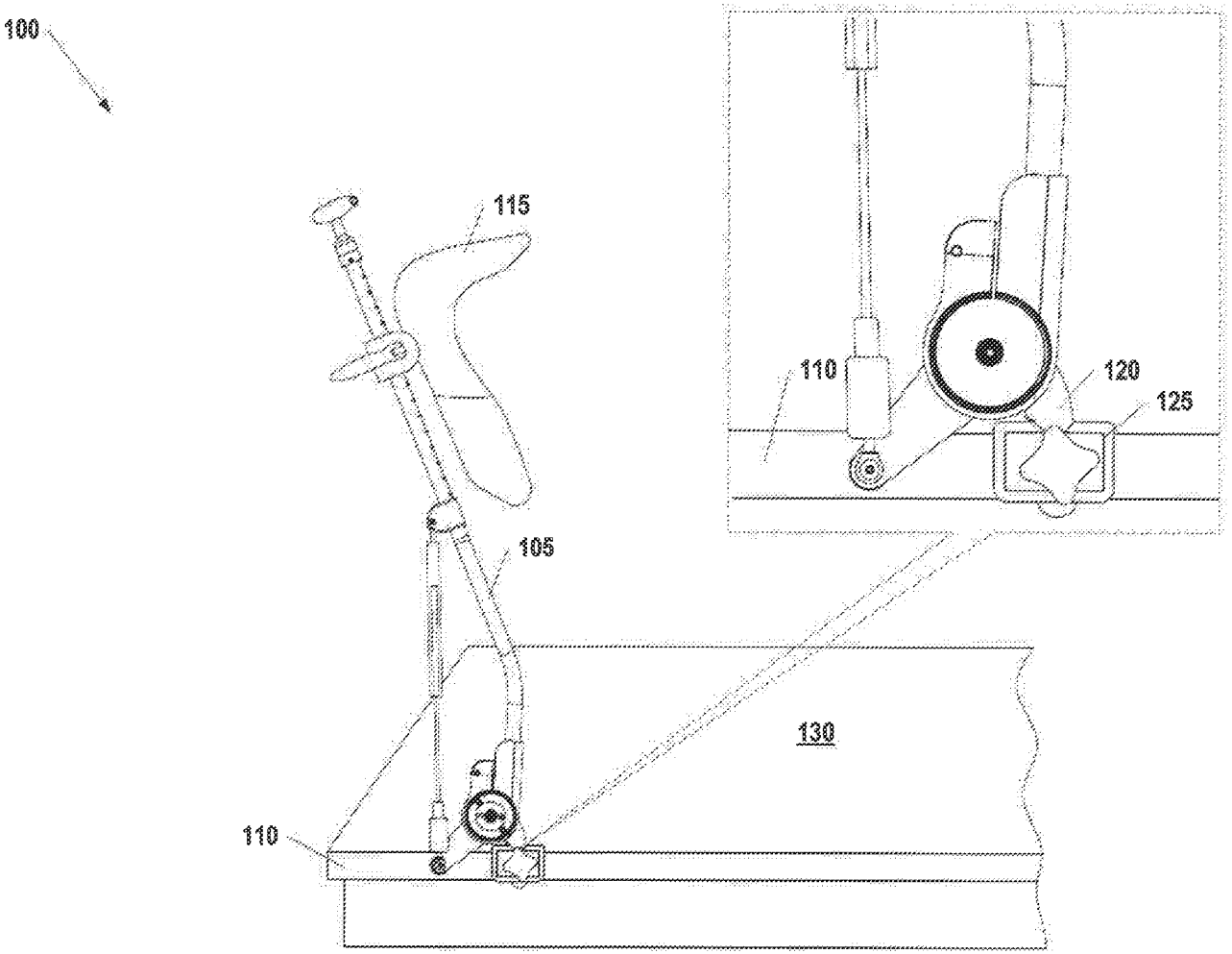
FIG. 1A provides an example of a lithotomy positioning system that illustrates the use oft (herein referred to as "Secure Release Clamp"), according to some embodiments.

FIG. 1A provides an example of a lithotomy positioning system 100 that illustrates the use of the Secure Release Clamp 125, according to some embodiments. Examples of such a lithotomy positioning system may be found in the U.S. patent application Ser. No. 15/706,231 entitled "Limb Holder Allowing Distal Actuation along Non-Linear Paths of Actuation," the entirety of which is incorporated herein by reference. Briefly, the system 100 includes a support structure 105 connected to a surgical table 130 via a mounting rail 110. During surgery or other clinical procedures, the patient's leg is secured in the support boot 115 and the support structure 105 holds the leg at a desired position. The support structure 105 includes a mount blade 120 that is coupled in the Secure Release Clamp 125 to secure the support structure 105 to mounting rail 110. In this example, the Secure Release Clamp 125 is coupled with the mount blade 120 in such a way that the mount blade 120 does not obstruct the connection of the Secure Release Clamp 125 with the mounting rail 110. Mechanically combining the mount blade 120 with the Secure Release Clamp 125 allows any forces exerted on the mount blade 120 by the support structure 105 to be transferred to the Secure Release Clamp 125 and subsequently to the rigid mounting rail 110.

It should be understood that the example set forth in FIG. 1A is meant for illustrative purposes and should not be viewed as limiting the scope of how a Secure Release Clamp can be utilized with surgical accessories. For example, as an alternative to the support structure 105, other surgical accessories employing mount blades may be used in conjunction with the Secure Release Clamp. The figures and examples that follow provide further detail on the design and operation of the Secure Release Clamp in general terms to illustrate how the Secure Release clamp is designed to accommodate accessories used in various surgical scenarios.

Figure 1B:
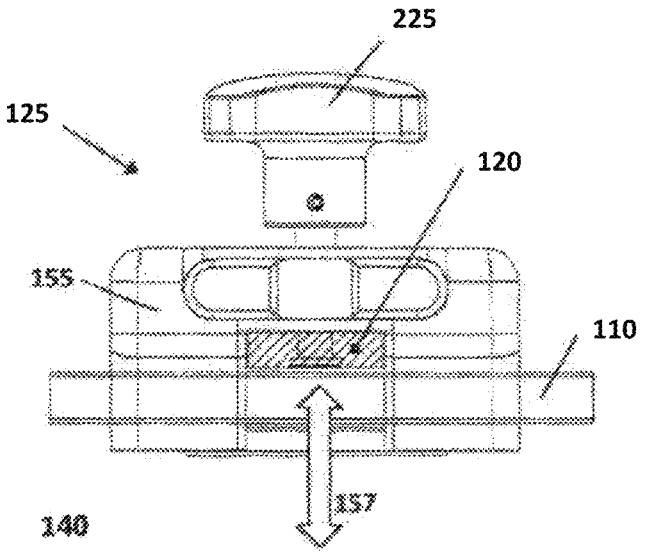
FIG. 1B illustrates a top view of the Secure Release Clamp and its relation to the mounting rail and the mount blade of an accessory.

FIGS. 1B-1E illustrate, for sake of reference, four different views of the Secure Release Clamp 125 and its relationship to the mounting rail 110 and the accessory mount blade 120. The top view 140 depicted in FIG. 1B shows the accessory mount blade 120 in a confined space bounded by a slot in the clamp body 155 and the mounting rail 110. The orthogonal direction 157, used to describe motion in Figures below, describes the direction in which the mount blade 120 moves toward or away from the parallel surface of the clamp body 155.

Figure 1C:
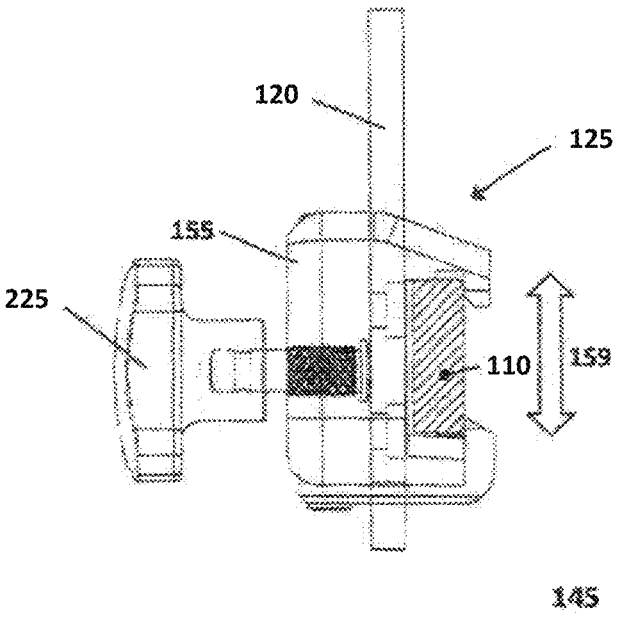
FIG. 1C illustrates the side view of the Secure Release Clamp and its relation to the mounting rail and the mount blade of an accessory.

The side view 145 depicted in FIG. 1C shows another view of the relative positions of the clamp body 155, the mounting rail 110 and the accessory mount blade 120. As shown in this view, the mounting rail 110 is restricted from moving in the orthogonal direction by the various portions of the Secure Release Clamp construct, including the clamp body 155. Primary load direction 159 is clearly confined by the horizontal surfaces of the construct shown in this view.

Figure 1D:
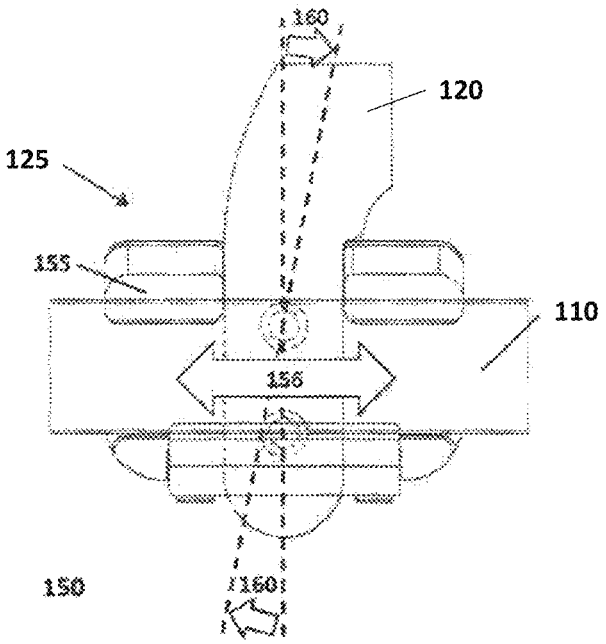
FIG. 1D illustrates a front view of the Secure Release Clamp and its relation to the mounting rail and the mount blade of an accessory.
Figure 1E:
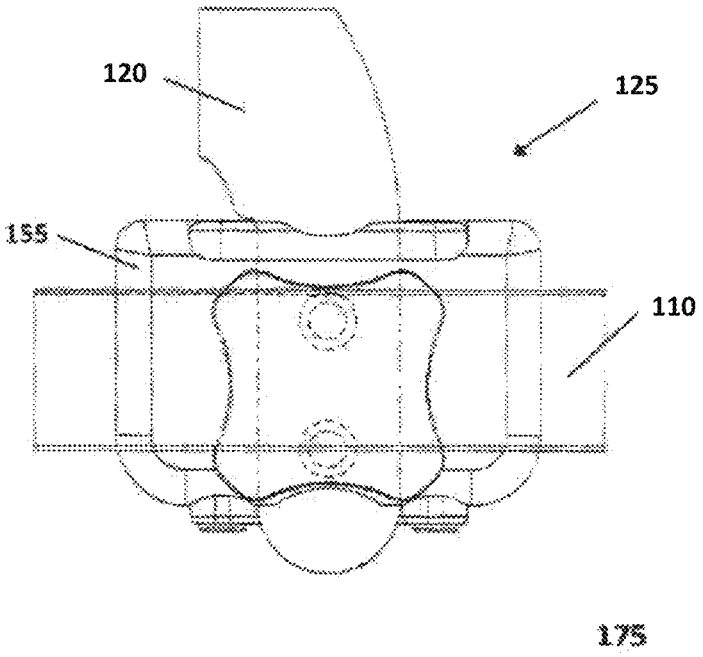
FIG. 1E illustrates a back view of the Secure Release Clamp and its relation to the mounting rail and the mount blade of an accessory.

The front view 150 shown in FIG. 1D depicts yet another relation between the clamp body 155, the accessory mount blade 120 and the mounting rail 110. Transverse direction 156 is only restricted when the Secure Release Clamp 125 is locked using clamp knob mechanism to push the accessory mount blade 120 orthogonally against the mounting rail 110, which is in turn pushed against portions of the clamp body 155. Further description of this locking action is described below. Diagonal motion 160 allows the accessory mount blade 120 to move slightly side to side on its mounting means in order to transfer the load from the accessory mount blade 120 onto the clamp body 155 rather than requiring the mounting means to support the load directly. Figures below will describe this motion in further detail. FIG. 1E provides a back view 175 of the Secure Release Clamp 125 and the clamp body 155 in relation to the mounting rail 110.

Figure 2A:
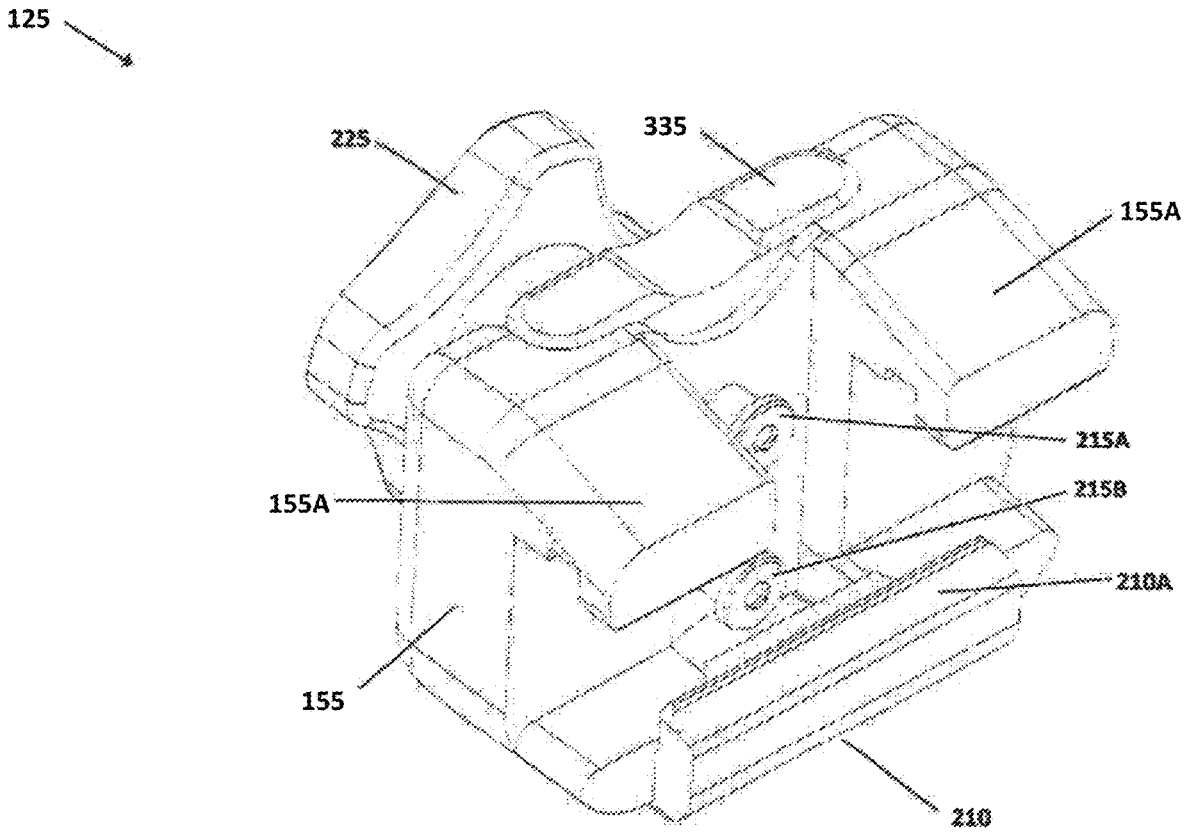
FIG. 2A provides a perspective view of a Secure Release Clamp, according to some embodiments of the present invention.

FIG. 2A shows a perspective view of a Secure Release Clamp 125, according to some embodiments of the present invention. The Secure Release Clamp 125 comprises a clamp body 155 and a locking plate component 210. When the Secure Release Clamp 125 is assembled, as in this figure, a channel (referred to herein as the "rail channel") is created by the space between the top clamp jaw components 155A of the clamp body 155 and the locking plate component 210. This rail channel runs transversely through the clamp body 155, while the vertical distance between the top clamp jaw components 155A and the locking plate component 210 is such that the vertical height of the mounting rail 110 (FIG. 1B) is held between them. The weight of the Secure Release Clamp 125 and any accessories attached to the clamp (example is support structure 105 in FIG. 1A) is supported by the top clamp jaw components 155A resting on the top surface of the mounting rail 110. The locking plate component 210 is designed to hold the Secure Release Clamp 125 from being inadvertently removed from the mounting rail 110.

Figure 2B:
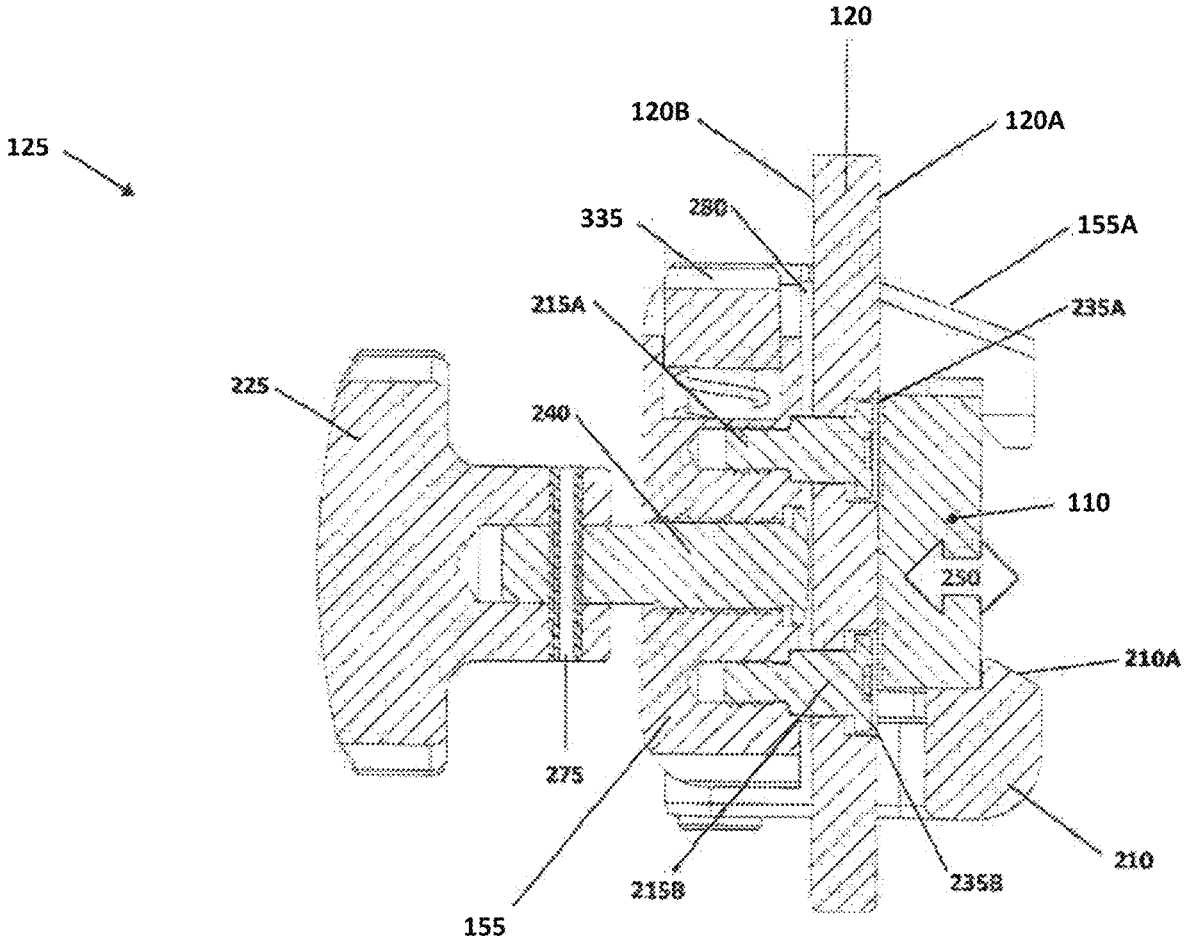
FIG. 2B illustrates how the Secure Release Clamp depicted in FIG. 2A can be coupled to a mount blade, shown in cross-section.

Continuing onto FIG. 2B, one or more mounting mechanisms are used to attach the accessory mount blade 120 to the clamp body 155. In this example, the mounting mechanism includes mounting screws 215A and 215B. These mounting screws 215A & 215B are common shoulder screws, but many other means of attachment generally known in the art may be employed. For example, a pin with a head could be secured into a mating hole and crossed-pinned in place. This and many other alternatives could be employed as a mounting mechanism to secure the mount blade 120 to the clamp body 155. Descriptions of alternatives to shoulder screws are not necessary here, but their possible use is recognized. Clamp knob 225 is attached to a threaded stud 240 and, in this embodiment, coil pin 275 couples the grip portion of the clamp knob 225 to the threaded stud 240 such that the rotation of the knob will advance or retract the threaded stud to provide securing force in the orthogonal direction 250. Turning the knob clockwise advances the threaded stud 240 which in turn pushes the accessory mount blade 120 orthogonally away from the clamp body 155 and against the mounting rail 110, creating the squeezing force necessary to hold the clamp/accessory combination in place. Rotating the grip portion of the clamp knob 225 counterclockwise, conversely, retracts the threaded stud 240 and releases the squeezing force to enable adjustment or removal of the Secure Release Clamp 125 from the mounting rail 110. Again, it is understood that there are many ways to secure the grip portion of the clamp knob 225 to the threaded stud 240 and the various means are beyond the scope of this invention. Furthermore, grip portion of the clamp knob 225 is shown in one of many possible shapes, with the singular intent of the grip portion of the clamp knob 225 allowing the user to gain some mechanical advantage for advancing or retracting the threaded stud 240. Typical knobs, levers and other types of handle/threaded stud configurations are well known and an exhaustive list of alternatives is not necessary here.

FIG. 2B also illustrates how the Secure Release Clamp 125 can be coupled to an accessory mount blade 120. The underside of top clamp jaw components 155A is sized and shaped to establish the upper portion of the rail channel. Similarly, the locking plate component 210 is sized and shaped to form the lower portion of the rail channel. The outer surface 120A of the accessory mount blade 120 establishes one vertical portion of the rail channel. Clamp body 155 includes two threaded holes sized to receive and secure the mounting screws 215A and 215B. The mounting screws each pass through countersunk holes 235A and 235B in the accessory mount blade 120 and into corresponding holes in the clamp body 155. The mounting screws have a shoulder of sufficient length to allow a gap 280 between the inner surface 120B of the accessory mount blade 120 and the adjacent wall of the clamp body 155. This gap allows orthogonal motion of the accessory mount blade 120 relative to the clamp body 155, enabling the threaded stud 240 to drive the mount blade 120 against the mounting rail 110 when the user rotates the grip portion of the clamp knob 225 counterclockwise and to move within that gap 280 when the threaded stud 240 is retracted. The countersunk portion of the holes 235A and 235B are sufficiently deep to allow the head of the mounting screws 215A to 215B to sit flush to or below the outer surface 120A when gap 280 is at its maximum dimension. The inner diameters of holes 235A and 235B are sized to provide sufficient clearance to the outer diameters of mounting screws 215A and 215B in order to allow orthogonal and diagonal motion of the accessory mount blade 120 (see FIG. 1B). The diagonal motion allows the edge of the accessory mount blade 120 to rest on portions of the clamp body 155 when loaded (see FIG. 1B), avoiding undue stress on the mount screws.

As in other descriptions, specific reference to dowels, screws, coil pins, etc. are not intended to limit the mechanical means of attachment to the methods described. For example, coil pins can be logically substituted with dowel pin, cotter pins, set screws and the like. Also, although the embodiment described above includes the mounting screws passing through the accessory mount blade and being secured in holes in the clamp body, it is also possible that the mounting screws could pass through holes in the clamp body and secure in holes in the accessory mount blade. Either version of this mechanical means of attachment would remain within the scope of this invention. Finally, it should be understood that holes described above can generally be any geometric shape, though circular is typical and advantageous to common manufacturing processes.

Figure 3:
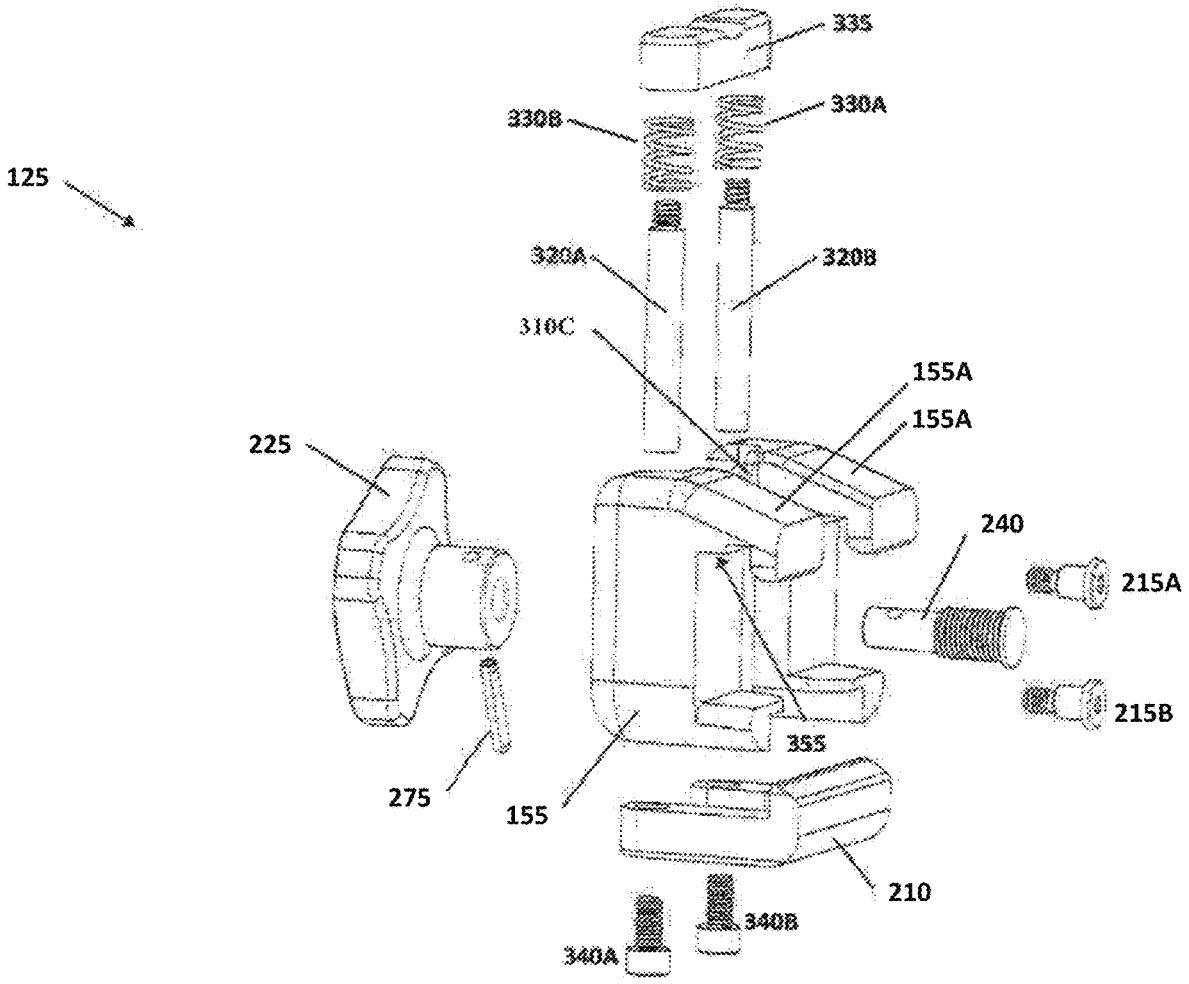
FIG. 3 provides an exploded view of a Secure Release Clamp, according to some embodiments.

FIG. 3 shows the exploded view of the Secure Release Clamp assembly described in prior Figures. Briefly, the biased clamp release mechanism includes an actuator (i.e., release button 335) attached to two parallel guide rods, 320A and 320B, by a threaded interface, which in turn pass through parallel holes in the clamp body 155 and attach to the locking plate component 210 with screws 340A and 340B. The clamp release mechanism is biased upward by two coil springs, 330A and 330B, that sit in pockets (shown in later Figures) and push up on the underside of the release button 335 to maintain the locking plate component 210 in a position closest to the underside 355 of the clamp jaw components 155A. It is understood that these coil springs could be replaced with wave springs, disc springs, other spring types or a compressible material that stores and releases energy. The coil springs are preferred in this embodiment, but other configurations in which the clamp release mechanism is forced into its idle state when activation forces are released are within the scope of this invention. When the release button 335 is pushed downward, the coil springs (330A and 330B) compress to allow the locking plate component 210 to move downward, increasing the space between the top clamp jaw components 155A and the locking plate component 210, enabling the mounting rail 110 to move into or out of the rail channel. When the release button 335 is no longer engaged, the coil springs extend and pull the locking plate back to its original position. The locking plate component 210 can also be moved downward without depressing the release button 335, which method is described in Figures below. It should be noted that, although release button 335 is shown as the actuator of the clamp release mechanism in FIG. 3, in other embodiments other actuators generally known in the art may alternatively be used. For example, in one embodiment, the actuator is a push bar.

Figure 4A:
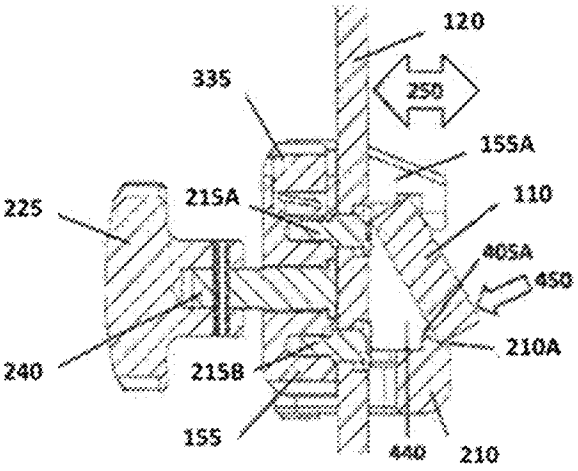
FIG. 4A illustrates the first step of coupling a Secure Release Clamp to a mounting rail, while attached to an accessory blade.

FIGS. 4A through 4D show the progression of steps in the process of mounting the Secure Release Clamp onto the operating table mounting rail 110. FIG. 4A illustrates that the accessory mount blade 120 is attached to clamp body 155 by mounting screws 215A and 215B, as described in Figures above, in such a way that does not impede on the rail channel receiving the mounting rail 110. For purposes of these Figures, the Secure Release Clamp is shown as stationary while the mounting rail 110 moves. Although, in practice, the mounting rail 110 would be stationary and the Secure Release Clamp would be angled relative to it, the relationship between the two is more clearly shown in the manner chosen here.

As seen in FIG. 4A, the mounting rail 110 can enter the rail channel in a diagonal orientation relative to the rail channel, with the top portion of the mounting rail 110 engaging the underside of top jaw 155A. Lower corner of mounting rail 110 contacts the inclined portion of the locking plate component 210 which in this view currently impedes the motion in the mounting direction 450. The coil springs of the clamp release mechanism described in FIG. 3 maintains the locking plate component 210 in this position until force on the release button 335 is applied or force is applied to locking plate component 210 as in the case described here.

Figure 4B:
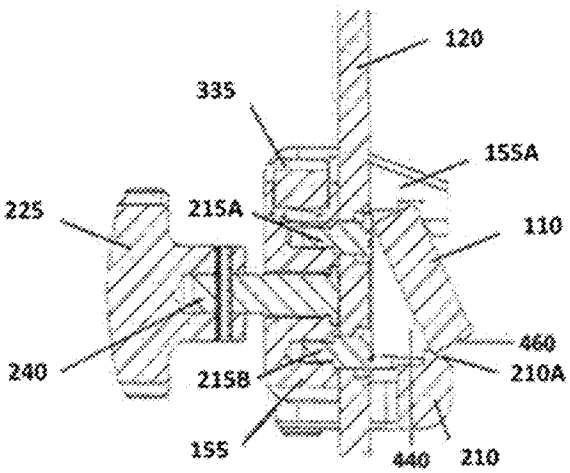
FIG. 4B illustrates the second step of coupling a Secure Release Clamp to a mounting rail, while attached to an accessory blade.

FIG. 4B shows the mounting motion causing the lower corner of mounting rail 110 to engage against the incline plane 210A of locking plate component 210, imposing a downward force component on the clamp release mechanism. The biasing upward force, exerted upward by two coil springs, 330A and 330B (not shown see FIG. 3) in combination the two parallel guide rods, 320A and 320B (not shown see FIG. 3), on locking plate component 210 is overcome and the clamp release mechanism begins to move mounting rail 110 downwards and away to open the rail channel 440.

Figure 4C:
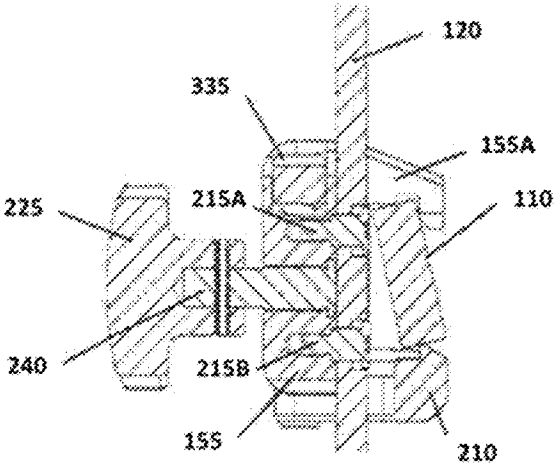
FIG. 4C illustrates the third step of coupling a Secure Release Clamp to a mounting rail, while attached to an accessory blade.

FIG. 4C shows the lower corner of the mounting rail 110 rotated further in mounting direction 450 (see FIG. 4A), allowing this corner to pass over the peak of the incline plane of locking plate component 210. With the coil springs (330A and 330B not shown see FIG. 3) of the clamp release mechanism pulling the locking plate component 210 upward, the peak of the incline of locking plate component 210 maintains contact with the lower surface of mounting rail 110. At this point, the mounting rail 110 may move into or out of the rail channel 440 without impediment. For purposes of this description, it is assumed that the mounting rail 110 continues to move in the mounting direction 450.

Figure 4D:
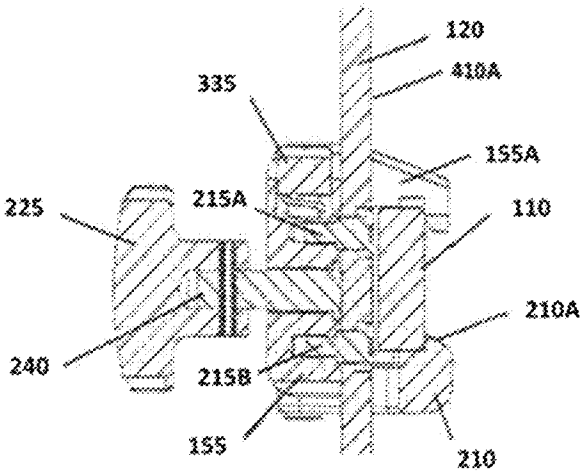
FIG. 4D illustrates the fourth step of coupling a Secure Release Clamp to a mounting rail, while attached to an accessory blade.

FIG. 4D illustrates the "mounted" relationship between the Secure Release Clamp and the mounting rail 110. In this case, the mounting rail 110 has moved completely into the rail channel 440 (FIG. 4A) and the coil springs of the clamp release mechanism have pulled the locking plate component 210 against the bottom surface 460 (FIG. 4B) of the mounting rail 110. In this configuration, the outside leg of the locking plate component 210 now blocks motion required to remove the mounting rail 110 from the rail channel 440. With the Secure Release Clamp now mounted on the mounting rail 110, the clamping knob 225 can now be rotated to advance threaded stud 240 against the accessory mount blade 120, which in turn moves orthogonally and secures the mounting rail 110 between the outer surface 120A of the accessory mount blade 120 and the parallel inner surfaces of the top jaw 155A and the locking plate component 210. Only by rotating the clamping knob 225, thereby retracting the threaded stud 240 and depressing the release button 335 can the locking plate component 210 be lowered, allowing the mounting rail 110 to exit the rail channel 440.

Figure 5A:
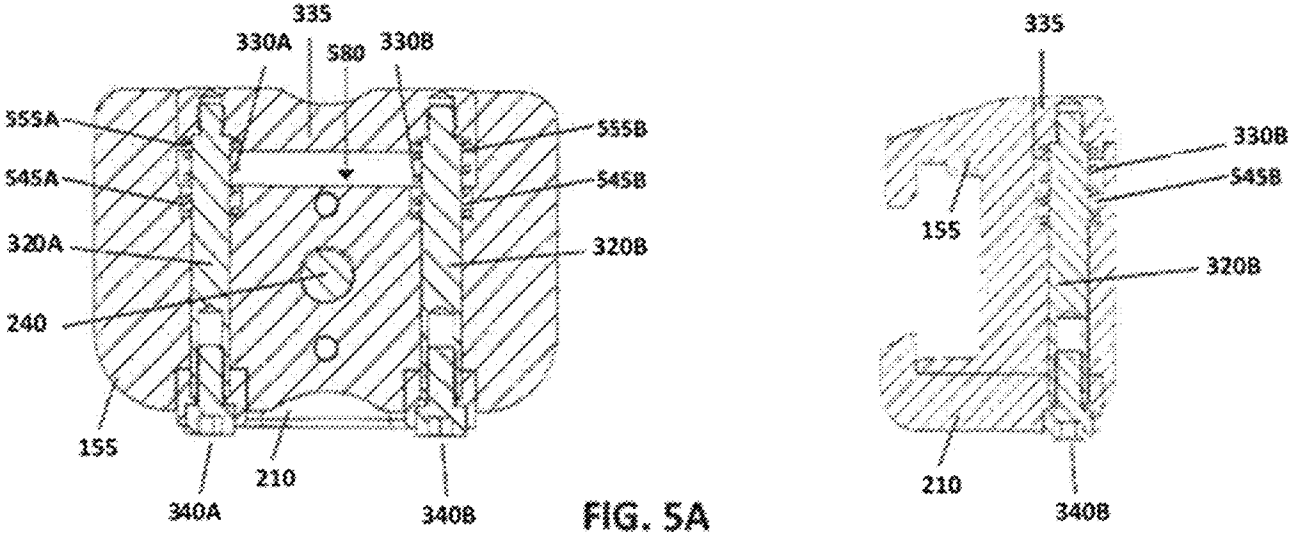
FIG. 5A describes a clamp release mechanism according to an embodiment to the present teachings and its components, in its idle state.

FIG. 5A shows a cross-section of the Secure Release Clamp in the idle state to further illustrate the coupled relationship between the components of the clamp release mechanism. Release button 335 is clearly coupled to the parallel guide rods 320A and 320B, in this case, by a threaded engagement and the locking plate component 210 is clearly coupled to the parallel guide rods with screws 340A and 340B. Coil springs 330A and 330B are confined within pockets 545A and 545B that are bored into clamp body 155 and pockets 555A and 555B that are bored into release button 335. In this idle state, the coil springs are expanded and hold the clamp release mechanism such that the locking plate component 210 rests against the surface 570 (see FIG. 5B) of a pocket in the bottom of the clamp body 155. The upper surface of the release button 335 has a curved feature only for the purposes of indicating to the user where to place their thumb or finger.

Figure 5B:
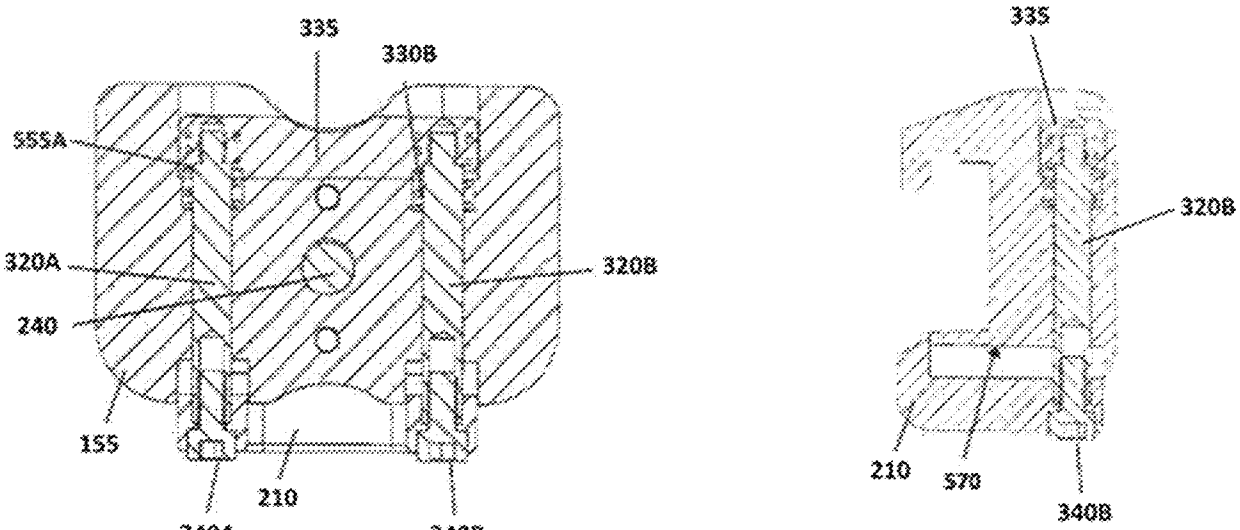
FIG. 5B describes the clamp release mechanism depicted in FIG. 5A and its components, in its activated state.

FIG. 5B shows the same mechanism described in FIG. 5A, but in the activated state. In this figure, the coil springs 330A and 330B (see FIG. 5A) are compressed, either by a user pushing the release button 335 or by the mounting sequence described in FIGS. 4A through 4D. The underside of the release button 335 is now in contact against surface 580 (See FIG. 5 A) and the locking plate component 210 has moved away from surface 570. As is evident in FIGS. 5A and 5B, the rail channel is well confined in the idle state and completely accessible in the activated state. Further, when considered with the sequence described in FIGS. 4A through 4D, the mounting rail may act upon the clamp release mechanism to create access required to enter the rail channel, but only the act of the user depressing the release button 335 can allow the mounting rail to exit the rail channel of the Select Release Clamp.

The systems and apparatus shown in the Figures are not exclusive. Other systems and apparatuses may be derived in accordance with the principles of the invention to accomplish the same objectives. Although this invention has been described with reference to particular embodiments, it is to be understood that the embodiments and variations shown and described herein are for illustration purposes only.

Modification to the current design may be implemented by those skilled in the art, without departing from the scope of the invention. No claim element herein is to be construed under provisions of 35 U.S.C. 112(f) unless the element is expressly recited using the phrase "means for".

We claim:

1. An apparatus for attaching a surgical accessory to a mounting rail, the apparatus comprising:

a clamp body comprising at least one clamp jaw component and one or more mounting mechanisms for attaching a mount blade of a surgical accessory to the clamp body such that the mount blade is movable between a retracted position and a loaded position, wherein in the loaded position the mount blade presses against said mounting rail for facilitating securing the clamp body to the mounting rail, a locking plate component configured for coupling to the clamp body via one or more fasteners such that a rail channel is formed between the at least one clamp jaw component and the locking plate component; and a clamp release mechanism comprising an actuator, wherein the clamp release mechanism moves to allow the mounting rail to enter or exit the rail channel in response to (a) a force applied to the locking plate component or (b) activation of the actuator.

2. The apparatus of claim 1, wherein the actuator comprises a release push bar or button, which when depressed, causes the activation of the clamp release mechanism.

3. The apparatus of claim 2, wherein the clamp release mechanism further comprises:

one or more guide rods, wherein each guide rod is coupled to (a) the push bar or release button at a top portion of the guide rod and (b) the locking plate component at a bottom portion of the guide rod; and one or more biasing springs, wherein each biasing spring forces the clamp release mechanism toward an idle state, wherein the push bar or release button is configured to act against the one or more biasing springs when depressed and cause movement of the one or more guide rods and the locking plate component away from the clamp body, thereby enabling access to or egress of the mounting rail from the rail channel.

4. The apparatus in claim 3, wherein, in response to ceasing the depression of the release push bar or button, the biasing springs are configured to cause movement of the one or more guide rods and the locking plate component toward the clamp body, thereby impeding egress of the mounting rail from the rail channel.

5. The apparatus in claim 3, wherein the one or more guide rods and the locking plate component are fixedly coupled with each other.

6. The apparatus of claim 1, further comprising:

a clamp knob or handle mechanism comprising a grip portion coupled to a threaded stud which mates with a threaded hole in the clamp body, wherein the clamp knob or handle mechanism is configured to move the threaded stud (a) toward the mount blade of the surgical accessory when the clamp knob or handle mechanism is turned in a first direction, causing the mount blade to be moved to the loaded position, and (b) away from the mount blade of the surgical accessory when the clamp knob or handle mechanism is turned in a second direction, causing the mount blade to be moved to the retracted position.

7. The apparatus of claim 1, wherein the locking plate component includes an inclined plane that engages with the mounting rail during installation of the apparatus onto the mounting rail, generating a force to activate the clamp release mechanism.

8. The apparatus of claim 1, wherein the mounting mechanisms for attaching the mount blade of the surgical accessory to the clamp body comprise one or more mechanical means of attachment which are fitted through holes in the mount blade into a corresponding hole, or holes, in the clamp body such that the clamp body is attached to the mounting rail without an interference by the mechanical means of attachment.

9. The apparatus of claim 1, wherein the mounting mechanisms for attaching the mount blade of the surgical accessory to the clamp body comprise one or more mechanical means of attachment which are fitted through a hole or holes in the mount blade into a corresponding hole, or holes, in the clamp body such that the mechanical means of attachment allows orthogonal and diagonal motion of the clamp body relative to the mount blade.

10. The apparatus of claim 1, wherein the mounting mechanisms for attaching the mount blade of the surgical accessory to the clamp body comprise one or more mechanical means of attachment which are fitted through a hole, or holes, in the mount blade into a corresponding hole, or holes, in the clamp body such that the mechanical means of attachment allows orthogonal and diagonal motion of the mount blade relative to the clamp body.

11. The apparatus of claim 1, wherein the surgical accessory is a limb holder support structure of a lithotomy positioning system.

12. A surgical apparatus comprising:

a surgical accessory comprising a mount blade;

a clamp comprising:

a clamp body;

a locking plate component; and a clamp release mechanism allowing movement of the locking plate component relative to the clamp body, thereby allowing the clamp to be (a) securely attached to a mounting rail or (b) removed from the mounting rail; and a mounting mechanism coupling the mount blade to the clamp such that the mount blade is movable between a retracted position and a loaded position, wherein in the loaded position the mount blade presses against said mounting rail for facilitating securing the clamp body to the mounting rail.

13. The apparatus of claim 12, wherein the clamp is attached to the mounting rail without an interference by the mounting mechanism.

14. The apparatus of claim 12, wherein the clamp release mechanism comprises a release bar or button that, when depressed, causes the activation of the clamp release mechanism.

15. The apparatus of claim 12, wherein the clamp release mechanism comprises:

one or more guide rods, wherein each guide rod is coupled to (a) the release bar or button at a top portion of the guide rod and (b) the locking plate component at a bottom portion of the guide rod; and one or more biasing springs, wherein each biasing spring forces the clamp release mechanism towards an idle state, wherein the release bar or button is configured to act against the one or more biasing springs when depressed and cause movement of one or more guide rods and the locking plate component away from the clamp body, thereby enabling access to or egress of a mounting rail from a rail channel formed between the clamp body and the locking plate component.

16. The apparatus of claim 15, wherein, when depression of the release bar or button is ceased, the biasing springs are configured to cause movement of the one or more guide rods and the locking plate component toward the clamp body, thereby impeding egress of a mounting rail from the rail channel.

17. The apparatus of claim 12, further comprising:

a clamp knob or handle mechanism comprising a grip portion coupled to a threaded stud which mates with a threaded hole in the clamp body, wherein the clamp knob or handle mechanism is configured to move the threaded stud (a) toward the mount blade of a surgical accessory when the clamp knob or handle mechanism is turned in a first direction, causing the mount blade to be moved to the loaded position, and (b) away from the mount blade of the surgical accessory when the clamp knob or handle mechanism is turned in a second direction, causing the mount blade to be moved to the retracted position.

18. The apparatus of claim 12, wherein the locking plate component includes an inclined plane that engages with the mounting rail during installation of the apparatus onto the mounting rail, generating a force to activate the clamp release mechanism.

19. The apparatus of claim 12, wherein the mounting mechanism for attaching the mount blade of a surgical accessory to the clamp body comprises one or more mechanical means of attachment that are fitted through a hole, or holes, in the mount blade into a corresponding hole, or holes, in the clamp body.

20. The apparatus of claim 12, wherein the mounting mechanism for attaching the mount blade of a surgical accessory to the clamp body comprises one or more mechanical means of attachment which are fitted through a hole, or holes, in the mount blade into a corresponding hole, or holes, in the clamp body such that the mechanical means of attachment allows orthogonal and diagonal motion of the mount blade relative to the clamp body.

21. A surgical apparatus, comprising:

a surgical accessory comprising a support structure and a mount blade;

a clamp comprising an actuation mechanism allowing selective attachment and release of the clamp from a mounting rail; and one or more mounting mechanisms coupling the mount blade to the clamp and allowing forces exerted on the mount blade by the support structure to be transferred to the clamp, wherein the mount blade is movable between a retracted position and a loaded position, wherein in the loaded position the mount blade presses against said mounting rail for facilitating securing the clamp body to the mounting rail.

22. The apparatus of claim 21, wherein the one or more mounting mechanisms coupling the mount blade of the surgical accessory to the clamp comprise one or more mechanical means of attachment which are fitted through a hole, or holes, in the mount blade into a corresponding hole, or holes, in the clamp such that the clamp is attached to the mounting rail without an interference by the one or more mechanical means of attachment.

* * * * *